US010906096B2

(12) United States Patent
Rebbecchi et al.

(10) Patent No.: US 10,906,096 B2
(45) Date of Patent: Feb. 2, 2021

(54) METHOD FOR MAGNETIC FLUX COMPENSATION IN A DIRECTIONAL SOLIDIFICATION FURNACE UTILIZING AN ACTUATED SECONDARY COIL

(71) Applicant: United Technologies Corporation, Farmington, CT (US)

(72) Inventors: Thomas Anthony Rebbecchi, Hartford, CT (US); Joseph V. Mantese, Ellington, CT (US); Ryan C. Breneman, West Hartford, CT (US); Andrew Boyne, West Hartford, CT (US); John Joseph Marcin, Marlborough, CT (US); Dustin W. Davis, Marlborough, CT (US); David Ulrich Furrer, Marlborough, CT (US); James Tilsley Auxier, Bloomfield, CT (US)

(73) Assignee: Raytheon Technologies Corporation, Farmington, CT (US)

( * ) Notice: Subject to any disclaimer, the term of this patent is extended or adjusted under 35 U.S.C. 154(b) by 0 days.

(21) Appl. No.: 16/781,403

(22) Filed: Feb. 4, 2020

(65) Prior Publication Data

US 2020/0171567 A1 Jun. 4, 2020

Related U.S. Application Data

(62) Division of application No. 15/797,823, filed on Oct. 30, 2017, now Pat. No. 10,589,351.

(51) Int. Cl.
*B22D 27/04* (2006.01)
*B22D 27/02* (2006.01)
(Continued)

(52) U.S. Cl.
CPC ..... *B22D 27/045* (2013.01); *B22D 27/02* (2013.01); *F27B 14/061* (2013.01); *F27B 14/14* (2013.01); *F27B 2014/066* (2013.01)

(58) Field of Classification Search
CPC ..... B22D 27/02; B22D 27/045; F27B 14/061; F27B 14/14
See application file for complete search history.

(56) References Cited

U.S. PATENT DOCUMENTS 3,538,981 A 11/1970 Phipps, Jr.
3,700,023 A 10/1972 Giamei et al.
(Continued)

FOREIGN PATENT DOCUMENTS

EP 2233228 A1 9/2010
EP 2363673 A1 9/2011
(Continued)

OTHER PUBLICATIONS

European Search Report dated Apr. 16, 2019 issued for corresponding European Patent Application No. 18203535.2.
(Continued)

*Primary Examiner* — Kevin E Yoon
(74) *Attorney, Agent, or Firm* — Bachman & LaPointe, P.C.

(57) ABSTRACT

A process for directional solidification of a cast part comprises energizing a primary inductive coil coupled to a chamber having a mold containing a material; generating an electromagnetic field with the primary inductive coil within the chamber, wherein said electromagnetic field is partially attenuated by a susceptor coupled to said chamber between said primary inductive coil and said mold; determining a magnetic flux profile of the electromagnetic field after it passes through the susceptor; sensing a component of the magnetic flux in the interior of the susceptor proximate the
(Continued)

mold; positioning a mobile secondary compensation coil within the chamber; generating a control field from a secondary compensation coil, wherein said control field controls said magnetic flux; and casting the material within the mold.

6 Claims, 3 Drawing Sheets

(51) Int. Cl.
*F27B 14/14* (2006.01)
*F27B 14/06* (2006.01)

(56) References Cited

U.S. PATENT DOCUMENTS

| | | | |
|---|---|---|---|
| 3,841,384 | A | 10/1974 | Tingquist et al. |
| 4,108,236 | A | 8/1978 | Salkeld |
| 4,202,400 | A | 5/1980 | Gigliotti et al. |
| 4,213,497 | A | 7/1980 | Sawyer |
| 4,409,451 | A | 10/1983 | Taylor |
| 4,774,992 | A | 10/1988 | George |
| 5,319,670 | A | 6/1994 | Fox |
| 5,375,647 | A | 12/1994 | Fang et al. |
| 5,592,984 | A | 1/1997 | Schmiedeknecht et al. |
| 5,848,635 | A | 12/1998 | Aoi et al. |
| 5,901,170 | A | 5/1999 | Peysakhovich et al. |
| 6,059,015 | A | 5/2000 | Bewlay et al. |
| 6,510,889 | B2 | 1/2003 | Thompson et al. |
| 7,167,501 | B2 | 1/2007 | Roberts et al. |
| 7,735,544 | B2 | 6/2010 | Kolesnichenko et al. |
| 8,242,420 | B2 | 8/2012 | Fishman |
| 9,025,636 | B2 * | 5/2015 | Chen ..... H05B 6/367 373/150 |
| 9,476,645 | B2 | 10/2016 | Keough |
| 10,022,787 | B2 | 7/2018 | Haun et al. |
| 10,207,321 | B2 | 2/2019 | Jarvis et al. |
| 2001/0050942 | A1 | 12/2001 | Soderstrom et al. |
| 2003/0234092 | A1 | 12/2003 | Brinegar |
| 2010/0126410 | A1 | 5/2010 | Fu et al. |
| 2010/0238967 | A1 | 9/2010 | Bullied et al. |
| 2012/0297580 | A1 | 11/2012 | Dughiero et al. |
| 2013/0276939 | A1 | 10/2013 | Ebisu |
| 2016/0288266 | A1 | 10/2016 | Rockstroh et al. |
| 2019/0126344 | A1 | 5/2019 | Rebbecchi |

FOREIGN PATENT DOCUMENTS

| | | | |
|---|---|---|---|
| EP | 3038771 | A1 | 7/2016 |
| EP | 3135401 | A1 | 3/2017 |
| KR | 20140041250 | A | 4/2014 |
| WO | 2011048473 | A1 | 4/2011 |

OTHER PUBLICATIONS

European Search Report dated Apr. 16, 2019 issued for corresponding European Patent Application No. 18203516.2.
European Search Report dated May 3, 2019 issued for corresponding European Patent Application No. 18203526.1.
European Search Report dated Apr. 16, 2019 issued for corresponding European Patent Application No. 18203513.9.
U.S. Office Action dated Oct. 1, 2018 issued for corresponding U.S. Appl. No. 15/797,855.
U.S. Office Action dated Dec. 16, 2019 issued for corresponding U.S. Appl. No. 15/797,799.
U.S. Office Action dated Nov. 12, 2019 issued for corresponding U.S. Appl. No. 15/797,888.

* cited by examiner

METHOD FOR MAGNETIC FLUX COMPENSATION IN A DIRECTIONAL SOLIDIFICATION FURNACE UTILIZING AN ACTUATED SECONDARY COIL

CROSS-REFERENCE TO RELATED APPLICATIONS

This application is a divisional of U.S. patent application Ser. No. 15/797,823, filed Oct. 30, 2017.

BACKGROUND

The present disclosure is directed to a method and device for directional solidification of a cast part. More particularly, this disclosure relates to a directional solidification casting process that controls a magnetic field to provide a desired microstructure.

A directional solidification (DS) casting process is utilized to impact crystal structure within a cast part. The desired orientation is provided by moving a mold from a hot zone within a furnace into a cooler zone at a desired rate. As the mold moves into the cooler zone, the molten material solidifies along a solidification front in one direction.

Mixing of the molten material at the solidification front within the furnace is known to be deleterious to the quality of single crystal castings. Such mixing can be induced in the molten metal material by a magnetic field generated from an energized coil encircling the furnace cavity. Typically, an induction withdrawal furnace utilizes such an electric coil that produces energy required for maintaining the metal in a molten state. A susceptor is utilized to transduce an electromagnetic field produced by the electric coil into radiant heat transferred to the casting mold.

The susceptor is usually a graphite cylinder located internal to the induction coil and external to the mold. The susceptor is heated by induction coils and radiates heat toward the mold to maintain metal in a molten state, and is intended to isolate the magnetic field from the hot zone of the furnace.

Casting single crystal gas turbine parts can experience less than 100% yields. Some defects that occur during the casting process are separately nucleated grains, freckels, porosity, mis-oriented boundaries, and others. The causes of these defects are not always known, but have been empirically determined to be influenced by the geometry of the part and the relative orientation of the part and the mold in the furnace. It is hypothesized that remnant magnetic field in the interior of the susceptor may be detrimental to the production of the desired microstructure in a cast part. Calculations have been made estimating the significance for a given production furnace design.

It has been recognized that the leakage of the magnetic field into the solidification zone could directly influence the solidification process during casting.

SUMMARY

In accordance with the present disclosure, there is provided a process for directional solidification of a cast part comprising energizing a primary inductive coil coupled to a chamber having a mold containing a material; generating an electromagnetic field with the primary inductive coil within the chamber, wherein the electromagnetic field is partially attenuated by a susceptor coupled to the chamber between the primary inductive coil and the mold; determining a magnetic flux profile of the electromagnetic field; sensing a component of the magnetic flux proximate the mold within the chamber; positioning a secondary compensation coil within the chamber generating a control field from a secondary compensation coil, wherein the control field controls the magnetic flux; and casting the material within the mold In another and alternative embodiment, the component of magnetic flux comprises a portion of the total electromagnetic field generated by the primary induction coil that pass through the susceptor and mold.

In another and alternative embodiment, the control field is increased or decreased to control a stirring in the material to produce a predetermined microstructure.

In another and alternative embodiment, the control field modifies a portion of the electromagnetic field produced by the primary induction coil that is not attenuated by the susceptor.

In another and alternative embodiment, the process further comprises generating a control signal, the control signal being responsive to at least one of a flux sensor input and a flux set point input.

In another and alternative embodiment, the control signal is sent to a power amplifier that generates the electrical power sent to the secondary compensation coil for generating the control field and the control signal is sent to an actuator coupled to the secondary compensation coil and configured to position the secondary compensation coil relative to the material within the mold.

In another and alternative embodiment, the secondary compensation coil is mobile relative to the susceptor.

In accordance with the present disclosure, there is provided an induction furnace assembly comprising a chamber having a mold; a primary inductive coil coupled to the chamber; a susceptor surrounding the chamber between the primary inductive coil and the mold; and at least one secondary compensation coil being mobile with respect to the chamber between the susceptor and the mold; the at least one secondary compensation coil configured to be positioned and to generate a control field configured to modify a magnetic flux past the susceptor from the primary induction coil.

In another and alternative embodiment, a controller is coupled to at least one flux sensor located within the chamber, wherein the controller is configured to generate a control signal responsive to an input from at least one of a flux sensor and a flux set point.

In another and alternative embodiment, a power amplifier is coupled to the controller and the at least one secondary compensation coil, wherein the power amplifier generates electrical power responsive to the control signal to the at least one secondary compensation coil to generate the control field.

In another and alternative embodiment, the magnetic flux leakage is sensed by at least one flux sensor at a predetermined location within the chamber.

In another and alternative embodiment, an actuator is coupled to the at least one mobile secondary compensation coil, the actuator configured to position the at least one secondary compensation coil relative to the mold and susceptor.

In another and alternative embodiment, the at least one mobile secondary compensation coil is coupled to a control system configured to control material casting.

In accordance with the present disclosure, there is provided a process for directional solidification of a cast part comprising generating a magnetic field from a primary inductive coil coupled to a chamber of an induction furnace, wherein the magnetic field includes a magnetic field flux that partially passes a susceptor coupled to the chamber between the primary inductive coil and a mold; controlling a predetermined amount of magnetic field flux that enters the mold inside the chamber by use of a control field generated by at least one mobile secondary compensation coil between the susceptor and the mold in the chamber; and casting a part within the mold from a molten material.

In another and alternative embodiment, the casting step further comprises cooling the molten material in the presence of the modified magnetic field.

In another and alternative embodiment, the process further comprises generating a control signal, the control signal being responsive to at least one of a flux sensor input and a flux set point input and determining the flux set point input at least one of empirically and via physics-based modeling.

In another and alternative embodiment, the process further comprises energizing the secondary compensation coil to generate the control field, responsive to the control signal.

In another and alternative embodiment, the process further comprises generating a control signal input to the mobile secondary compensation coil, the control signal input comprising at least one of a control signal input to nullify the magnetic flux experienced by the mold, and a control signal input to amplify the magnetic flux experienced by the mold.

In another and alternative embodiment, the process further comprises sensing the magnetic field flux past the susceptor within the chamber with at least one flux sensor.

In another and alternative embodiment, the process further comprises positioning the at least one secondary compensation coil coupled to an actuator configured to position the at least one secondary compensation coil relative to the mold.

Other details of the method and device for directional solidification of a cast part are set forth in the following detailed description and the accompanying drawings wherein like reference numerals depict like elements.

DETAILED DESCRIPTION

Figure 1:
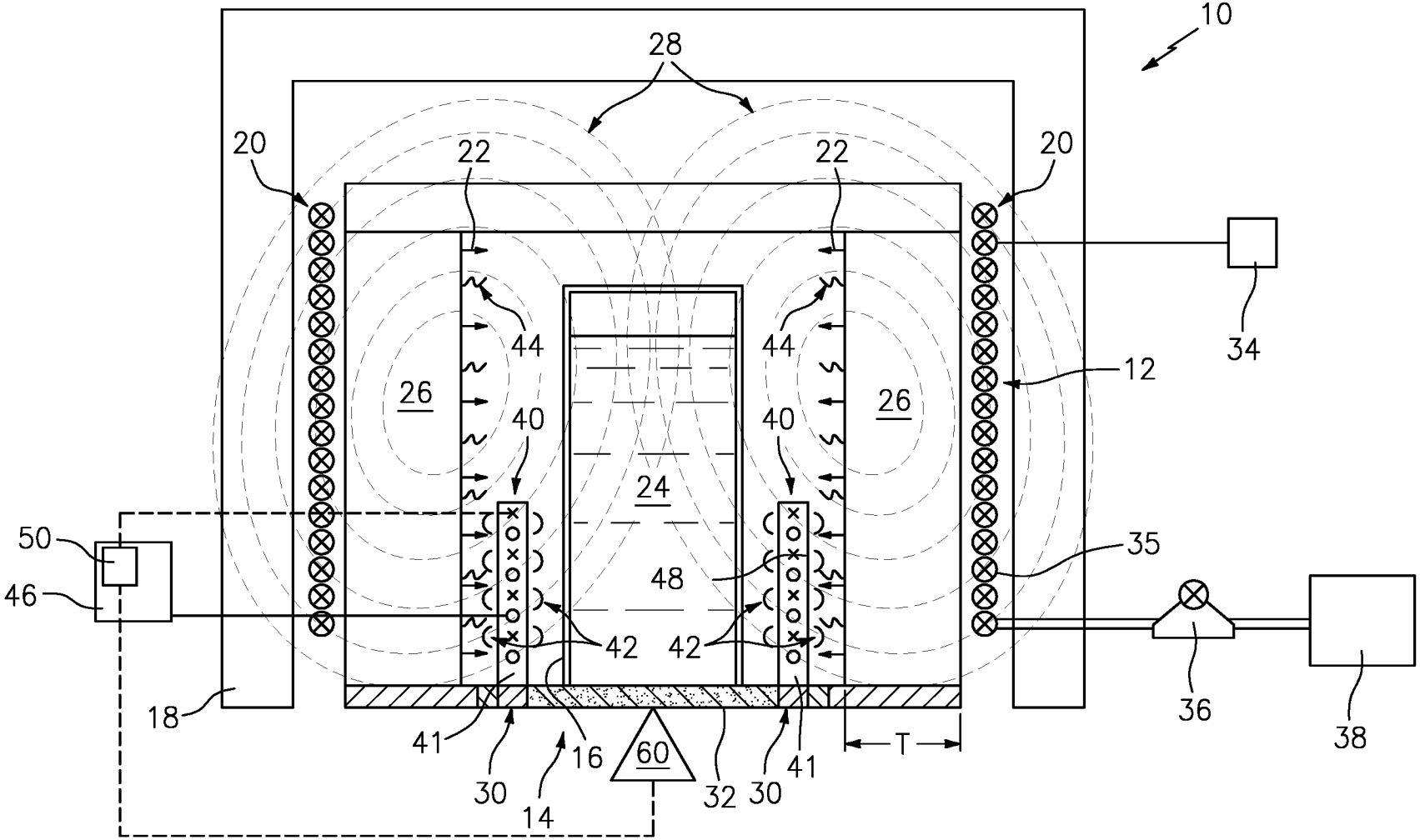
FIG. 1 is a schematic illustration of an exemplary inductive furnace with a mold disposed within the furnace.

Referring to FIG. 1, an exemplary induction furnace assembly 10 includes a chamber 12 that includes an opening 14 through which a mold 16 is received and withdrawn. The chamber 12 is isolated from the external environment by insulated walls 18. A primary inductive coil 20 generates an electromagnetic field 28 which is converted into heat by the susceptor, heat indicated by arrows 22, to heat a material 24 within the mold 16 to a desired temperature.

The exemplary furnace assembly 10 includes a susceptor 26 that absorbs the electromagnetic field (schematically shown at 28) that is generated by the primary inductive coil 20. The susceptor 26 is a wall that surrounds the chamber 12. The susceptor 26 is fabricated from material such as graphite that absorbs the penetration of the electromagnetic field 28 produced by the primary inductive coil 20. The susceptor 26 can also provide for the translation of energy from the magnetic field into heat energy, as indicated at arrows 22 to further maintain a temperature within the mold 16. In the disclosed example, molten metal material 24 is disposed in the mold 16 which in turn is supported on a support 30. The support 30 includes a chill plate 32 that both supports the mold 16 and includes cooling features to aid in cooling and directional solidification of the molten material 24.

The primary inductive coil 20 receives electrical energy from an electric power source schematically indicated at 34. This electrical energy is provided at a desired current level determined to provide sufficient power and energy to create the desired temperature within the chamber 12 that maintains the metal 24 in a molten state.

The primary inductive coil 20 comprises a plurality of electrically conductive hollow tubes 35. The plurality of tubes 35 also provide for the circulation of a fluid that is generated by a pump 36 that supplies fluid from a fluid source 38 to flow through the tubes 35.

In operation, the furnace 10 is brought up to a desired temperature by providing a sufficient current from the electric power source 34 to the primary inductive coil 20. Water supplied from the pump 36 and fluid source 38 is pumped through the plurality of tubes 35 that make up the inductive coil 20. The heat 22 created by the partial conversion of the electromagnetic field by the susceptor 26 heats the core furnace zone of the chamber 12 to a desired temperature. Once a desired temperature is reached, molten material, metal 24 is poured into the mold 16. The mold 16 defines the external shape and features of the completed cast article.

In the exemplary directional solidification casting process utilized, after the molten material 24 is poured into the mold 16 within the chamber 12 the material 24 is maintained at a desired temperature in a molten state. The support 30 and chill plate 32 are then lowered from the opening 14 out of the hot chamber 12 through a baffle. The mold 16 is lowered from the chamber 12 at a desired rate to cool the molten material 24 in a controlled manner to produce desired columnar structure or single crystal. The controlled cooling produces a solidification front within the molten material 24 that moves upward through the part as it is withdrawn from the furnace chamber 12.

In many applications, the completed cast part is desired to include a specific grain structure. The grain structure within the completed cast part provide desired material characteristics and performance, such as for example material fatigue performance. The exemplary furnace assembly 10 includes the susceptor 26 with a constant thickness to block an amount of the electromagnetic field 28. The portion of electromagnetic field 28 that passes the susceptor 26 induces a certain amount of magnetic stirring within the molten metal material 24.

The generated electromagnetic field 28 not absorbed by the susceptor has a potential to produce currents within the molten metal material 24 that interact with the molten metal material 24 to provide stirring and mixing and may inhibit defect-free single crystal growth. In a standard induction furnace, the susceptor 26 is sized to include a thickness that is thick enough to shield the electromagnetic field within the hot zone of the chamber 12. However, it has been discovered that a certain amount of electromagnetic field 28 may leak past the susceptor 26. This magnetic field leakage, that is, magnetic flux leakage 44 may be unwanted and detrimental to proper grain structure formation.

The exemplary furnace 10 includes a secondary compensation coil 40 that can move relative to the chamber 12. The secondary compensation coil 40 is configured to generate a control field 42. The control field 42 can be a secondary electromagnetic field to control the local magnetic flux at the solidification front. The control field 42 can cancel or enhance magnetic flux leakage 44 or simply magnetic flux 44, from the primary induction coil 20. The control field 42 can be generated depending on the magnetic flux leakage 44 at predetermined locations, such as proximate the mold 16, within the chamber 12, within the mold 16, and the like. The magnetic flux leakage 44 can include the portions of the electromagnetic field 28 passing through the mold 16 that are not blocked by the susceptor 26.

The secondary compensation coil/hosing 40 contains a cylinder shaped coil and moves relative to the susceptor 26 and mold 16. The secondary compensation coil 40 can be mounted to the chill plate 32, as illustrated at FIG. 3. The secondary compensation coil 40 can be actuated into position within the hot zone of the chamber 12 between the susceptor 26 and mold 16 as illustrated in FIG. 1. The secondary compensation coil 40 can be coupled to a power amplifier 46. The power amplifier 46 can be coupled to flux sensors 48. The flux sensors 48 can transmit data to a controller 50 as part of a control system 52 shown in more detail at FIG. 2. The control field 42 can modify the total electromagnetic field produced by the primary induction coil 20 that is not attenuated by the susceptor 26. In this way stirring can be better controlled or eliminated within the molten material to produce castings with desired microstructure.

Figure 2:
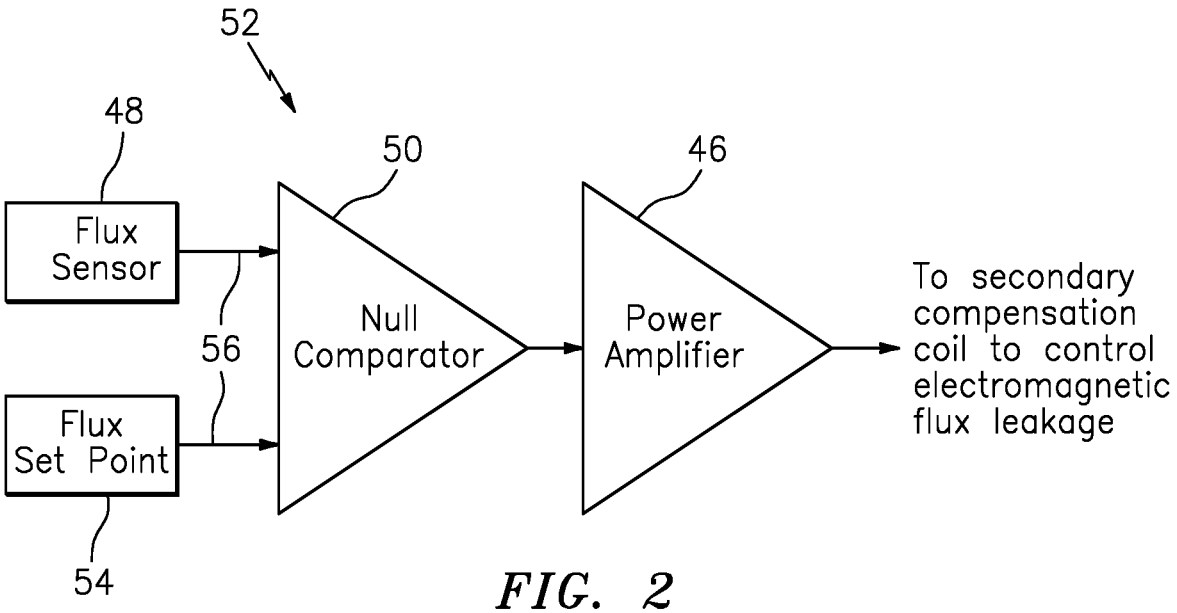
FIG. 2 is a controls schematic for an exemplary method and system for directional solidification of a cast part.
Figure 3:
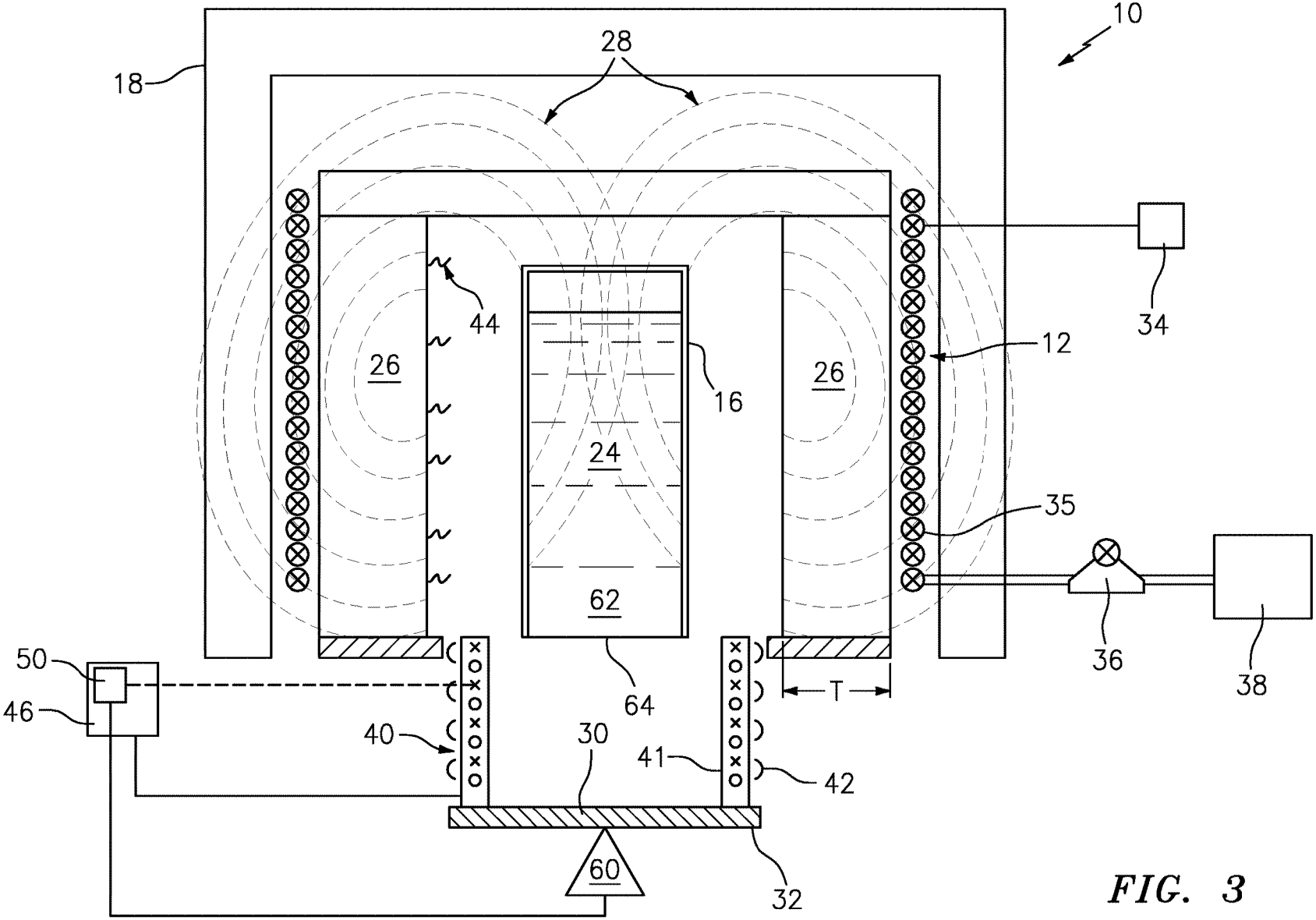
FIG. 3 is a schematic illustration of an exemplary inductive furnace with a mold disposed within the furnace.

As shown in FIG. 2, the control system 52 can include a plurality of magnetic flux sensors 48 positioned in predetermined locations for detection of the magnetic flux leakage 44. A flux set point 54 can be set based on empirical data, physics-based modeling, materials being cast, a property of the susceptor 26, a property of the primary inductive coil 20, the chamber 12 and the like. The flux set point 54 can be part of a proportional, differential, integral controller 50 that is designed to null out residual magnetic field or tailor a response such that magnetic stirring is controlled to desired set point. The actual control schedule may be derived through a combination of empirical setting data or by thermal fluid analysis of the melt. Alternatively, the control schedule response to the flux sensor 48 may be tailored to produce no stirring or some stirring, where again the actual controller signal 58 may be derived empirically or supported by thermal fluid analysis. The flux sensor(s) 48 and flux set point 54 provide inputs 56 to the controller 50. In an exemplary embodiment, the controller 50 can comprise a null point comparator. The controller 50 receives the inputs 56 from the flux sensor(s) 48 and flux set point 54 and generates a control signal 58 to the power amplifier 46. In an exemplary embodiment, the control signal 58 can comprise an error signal generated by the null point comparator. The power amplifier 46 then generates the electrical power to produce the frequency and amplitude to the secondary compensation coil 40 during the solidification process for control of the solidification of the metal 24. The secondary compensation coil 40 generates the control field 42.

Referring also to FIG. 3, the exemplary furnace 10 with the mobile secondary compensation coil 40 in a housing 41 that is mounted on the chill plate 32 and is configured to move into and out of the chamber 12 relative to the susceptor 26. An actuator 60 is operatively coupled to the secondary compensation coil 40. In an exemplary embodiment, the actuator 60 can be directly coupled to the secondary compensation coil 40. In an exemplary embodiment, the actuator 60 can be coupled to the support 30 and/or the chill plate 32 upon which the secondary compensation the secondary compensation coil 40 can be standalone, and be actuated into place and remain fixed relative to the chamber 12 as needed. The actuator 60 positions the secondary compensation coil 40 to be utilized for controlling the magnetic flux 44 from interfering with casting the material 24. The position of the secondary compensation coil 40 relative to the material 24 in the mold 16 can be predetermined so as to minimize or control the influence of the magnetic flux experienced by the material during casting.

In another exemplary embodiment, the secondary compensation coil 40 can be positioned to shield a portion of the material 24 in the mold 16. In an exemplary embodiment, the secondary compensation coil 40 can be positioned to shield a mushy zone 62 of material formation located proximate a bottom 64 of the mold 16. The mushy zone 62 starts at the bottom of the part and travels upward in the part as the part is withdrawn from the hot zone of the furnace chamber 12. The mushy zone 62 is fairly fixed relative to the furnace chamber 12 (at the hot zone-cold zone interface) but not the cast part. The secondary compensation coil 40 can also be positioned by the actuator (as shown in FIG. 1) responsive to input from the control system 52. The signals from the flux sensors 48 and/or flux set point 54 data can be utilized by the control system 52 to position the secondary compensation coil 40 for casting the material 24.

In an exemplary embodiment, the control field 42 can be utilized to "control to nullify." The electromagnetic control field 42 from the secondary compensation coil 40 can be created so that the control field 42 is partially or wholly out of phase with the electromagnetic field 28. The control system 52 can generate an appropriate control signal input 56 to the secondary compensation coil 40 to nullify the magnetic flux 44 experienced by the mold 16 to a range of about 0-200 Gauss range, 10 Gauss resolution, and 2 Gauss accuracy.

In an exemplary embodiment, the control field 42 can be utilized to "control to amplify." The electromagnetic control field 42 from the secondary compensation coil 40 can be created so that it is in phase with primary electromagnetic field 28. The control system 52 can generate an appropriate control signal input 56 to the secondary compensation coil 40 to amplify the magnetic flux 44 experienced by the mold 16 to a range of about 100-50,000 Gauss.

Figure 4:
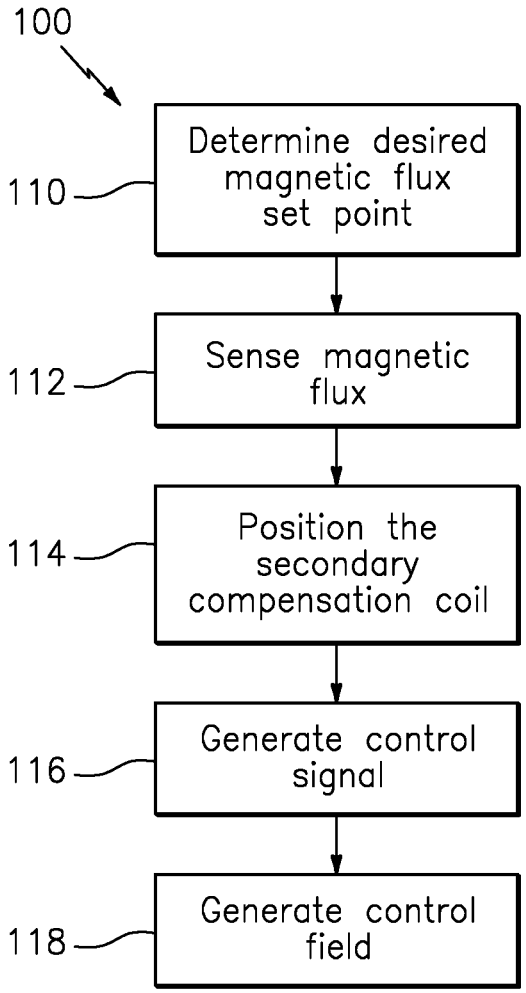
FIG. 4 is a process map of an exemplary method and system for directional solidification of a cast part.

An exemplary process map is illustrated at FIG. 4. The process for controlled solidification behavior 100, can include at step 110, determining a desired magnetic flux setpoint at a selected location in the chamber 12. At step 112, the magnetic flux is sensed at a predetermined location where flux control is desired. At step 114 the secondary compensation coil 40 is positioned to control the magnetic flux leakage 44. The positioning step can be enhanced by use of the controller 50, and the flux sensors 48 and/or flux set point 54. At step 116 a control signal can be generated by the controller 50. At step 118, a control field 42 can be generated by the secondary compensation coil 40. The amount, frequency and amplitude of electrical power can be used to drive the secondary compensation coil 40 to generate the control field 42 during solidification of the material 24 and the electromagnetic field 28 that influences the solidification of the material 24. In another exemplary embodiment, physics-based models can be utilized to actively control the power amplifier 46 and thus, generate the control field 42 to control the magnetic flux leakage 44.

It is desirable to control the magnetic stirring within the molten material 24 as the mold 16 leaves the hot chamber 12 to produce the desired grain structure within the completed cast part.

Accordingly, the disclosed exemplary inductive furnace assembly provides for the control of magnetic flux and resultant stirring through utilization of a mobile secondary compensation coil proximate the mold that in turn produce the desired grain structure with the cast part.

An actuated secondary coil as opposed to a stationary secondary coil allows for minimized disturbance of the process leading up to magnetic flux mitigation that might be imposed by a stationary coil.

There has been provided a method and device for directional solidification of a cast part. While the method and device for directional solidification of a cast part has been described in the context of specific embodiments thereof, other unforeseen alternatives, modifications, and variations may become apparent to those skilled in the art having read the foregoing description. Accordingly, it is intended to embrace those alternatives, modifications, and variations which fall within the broad scope of the appended claims.

What is claimed is:

1. An induction furnace assembly comprising:

a chamber having a mold;

a primary inductive coil coupled to said chamber;

a susceptor surrounding said chamber between said primary inductive coil and said mold; and at least one secondary compensation coil being mobile with respect to said chamber between said susceptor and said mold; said at least one secondary compensation coil configured to be positioned and to generate a control field configured to modify a magnetic flux past said susceptor from said primary induction coil.

2. The induction furnace assembly according to claim 1, further comprising:

a controller coupled to at least one flux sensor located within said chamber, wherein said controller is configured to generate a control signal responsive to an input from at least one of a flux sensor and a flux set point.

3. The induction furnace assembly according to claim 2, further comprising:

a power amplifier coupled to said controller and said at least one secondary compensation coil, wherein said power amplifier generates electrical power responsive to said control signal to said at least one secondary compensation coil to generate said control field.

4. The induction furnace assembly according to claim 2, wherein said magnetic flux is sensed by at least one flux sensor at a predetermined location within said chamber.

5. The induction furnace assembly according to claim 1, further comprising:

an actuator coupled to the at least one secondary compensation coil, said actuator configured to position said at least one secondary compensation coil relative to the mold and susceptor.

6. The induction furnace assembly according to claim 1, wherein said at least one secondary compensation coil is coupled to a control system configured to control material casting.

* * * * *